US009206703B2

(12) United States Patent
Tadayon

(10) Patent No.: US 9,206,703 B2
(45) Date of Patent: Dec. 8, 2015

(54) JET ENGINE CLEANING SYSTEM

(75) Inventor: Shahin Tadayon, Miamisburg, OH (US)

(73) Assignee: AERO JET WASH LLC, Miamisburg, OH (US)

( * ) Notice: Subject to any disclaimer, the term of this patent is extended or adjusted under 35 U.S.C. 154(b) by 973 days.

(21) Appl. No.: 13/286,588

(22) Filed: Nov. 1, 2011

(65) Prior Publication Data

US 2013/0104934 A1 May 2, 2013

(51) Int. Cl.
*B08B 7/04* (2006.01)
*F01D 25/00* (2006.01)

(52) U.S. Cl.
CPC ..... *F01D 25/002* (2013.01)

(58) Field of Classification Search
None
See application file for complete search history.

(56) References Cited

U.S. PATENT DOCUMENTS

| | | | | |
|---|---|---|---|---|
| 2,804,903 | A | 9/1957 | Davies | |
| 3,646,980 | A | 3/1972 | Peterson | |
| 5,143,321 | A | 9/1992 | Jackson | |
| 5,899,217 | A | 5/1999 | Testman, Jr. | |
| 2006/0219269 | A1 | 10/2006 | Rice | |
| 2008/0149141 | A1* | 6/2008 | Sales | 134/22.1 |
| 2009/0255943 | A1* | 10/2009 | Giljohann et al. | 220/666 |
| 2010/0000572 | A1 | 1/2010 | Giljohann et al. | |
| 2010/0095984 | A1* | 4/2010 | Tadayon | 134/10 |
| 2010/0200023 | A1 | 8/2010 | Giljohann et al. | |
| 2010/0243001 | A1 | 9/2010 | Amcoff | |

FOREIGN PATENT DOCUMENTS

| | | | |
|---|---|---|---|
| CA | 2570243 | A1 | 12/2005 |
| CA | 2714809 | A1 | 12/2005 |
| CA | 2611732 | A1 | 5/2009 |
| CA | 2742109 | A1 | 5/2010 |
| CA | 2697790 | A1 | 9/2010 |
| CA | 2623852 | A1 | 5/2011 |

OTHER PUBLICATIONS

International Search Report for PCT Application No. PCT/US2012/062763, Mailing Date of Dec. 14, 2012; Korean Intellectual Property Office; Republic of Korea.
Written Opinion of the International Searching Authority for PCT/US2012/062763; Mailing Date of Dec. 14, 2012; Korean Intellectual Property Office; Republic of Korea.

* cited by examiner

*Primary Examiner* — Eric Golightly
(74) *Attorney, Agent, or Firm* — Thomas E. Lees, LLC

(57) ABSTRACT

A system and method for washing a jet engine of an aircraft are disclosed. The method comprises creating a collecting bowl under the jet engine by coupling a suit to the jet engine of the aircraft and coupling an apron of the suit to the jet engine. After the suit is coupled to the jet engine, a cleaning cycle is performed, which includes injecting cleaning fluid into the jet engine, turning over the jet engine, and collecting resultant effluent in the bowl. Further, the effluent remains in the bowl until actively removed by a user. The suit may be coupled to the aircraft by wrapping a strap around a pylon that couples the jet engine to the aircraft.

13 Claims, 6 Drawing Sheets

JET ENGINE CLEANING SYSTEM

FIELD OF THE INVENTION

Embodiments of the present disclosure relate generally to cleaning fluid injection systems, collection systems and to suits operable with such cleaning fluid injection systems and collection systems for collecting effluent from an engine cleaning operation.

BACKGROUND

Several factors are involved in maintaining clean and efficient gas turbine engines. Such factors may include both preventive and non-preventative maintenance. Periodic engine cleaning is one such preventive maintenance practice that is recommended to minimize engine compressor and turbine contamination.

There are documented cases of one-time engine compressor wash improvements in Total Specific Fuel Consumption (TSFC) and Exhaust Gas Temperature (EGT) of 0.85% and 8° C., respectively. Additionally, cleaning an engine prior to contamination can be beneficial to engine performance. For example, a fleet TSFC improvement of 1.0% per year may be realized when performing engine cleanings every three months. Generally, the recommended engine cleaning interval is every 1000 to 1200 hours commencing after a heavy maintenance. In this regard, engine manufacturers have estimated a reduction of 1.0% TSFC and 10° C. EGT over a 6000 hour period with regular cleaning according to the recommended cleaning interval. Another benefit of cleaning an engine regularly is an ease in contamination removal at each wash.

An additional benefit of engine cleaning washes is the reduction of turbine sulphidation. Engine manufacturers' tests have shown that engine cleaning washes remove water soluble substances applied to the turbine. For example, a large domestic operator using engine cleaning washes at 100 to 150 hour intervals with expanded repair limits has been successful in reducing turbine blade scrap rate due to sulphidation damage at 6200 hours from 100% to less than 5%. It should be noted that engine cleaning for sulphidation reduction generally requires much shorter time intervals between washes than those used for regular compressor cleaning.

SUMMARY

According to various aspects of the present invention, a method for washing a jet engine of an aircraft is disclosed. The method comprises creating a collecting bowl under the jet engine by coupling a suit to the jet engine to the aircraft and coupling an apron of the suit to the jet engine. After the suit is coupled to the jet engine, a cleaning cycle is performed, which includes injecting cleaning fluid into the jet engine, turning over the jet engine, and collecting resultant effluent in the bowl. Further, the effluent remains in the bowl until actively removed by a user.

According to further aspects of the present invention, a system for collecting effluent from a jet engine wash is disclosed. The system comprises a waterproof suit including an apron and a strap coupled to the suit. However, the waterproof suit does not include a gravity driven drain, i.e., the suit retains any effluent collected until the effluent is actively removed by a user. The strap attaches the suit to the jet engine by wrapping around a pylon, which attaches the jet engine to be washed to an aircraft.

According to still further aspects of the present invention, a modified J-hook is disclosed. The J-hook comprises a tube including an input end, which includes a quick-connect coupler, and an output end that couples to a second tube that curves back on itself. The tube is coupled to a first plate, which is pivotally coupled to a second plate. The second plate is coupled to a C-clamp with two pressure plates and a tightening portion.

BRIEF DESCRIPTION OF THE DRAWINGS

The following detailed description of specific embodiments can be best understood when read in conjunction with the following drawings, where like structure is indicated with like reference numerals and in which.

Figure 1:
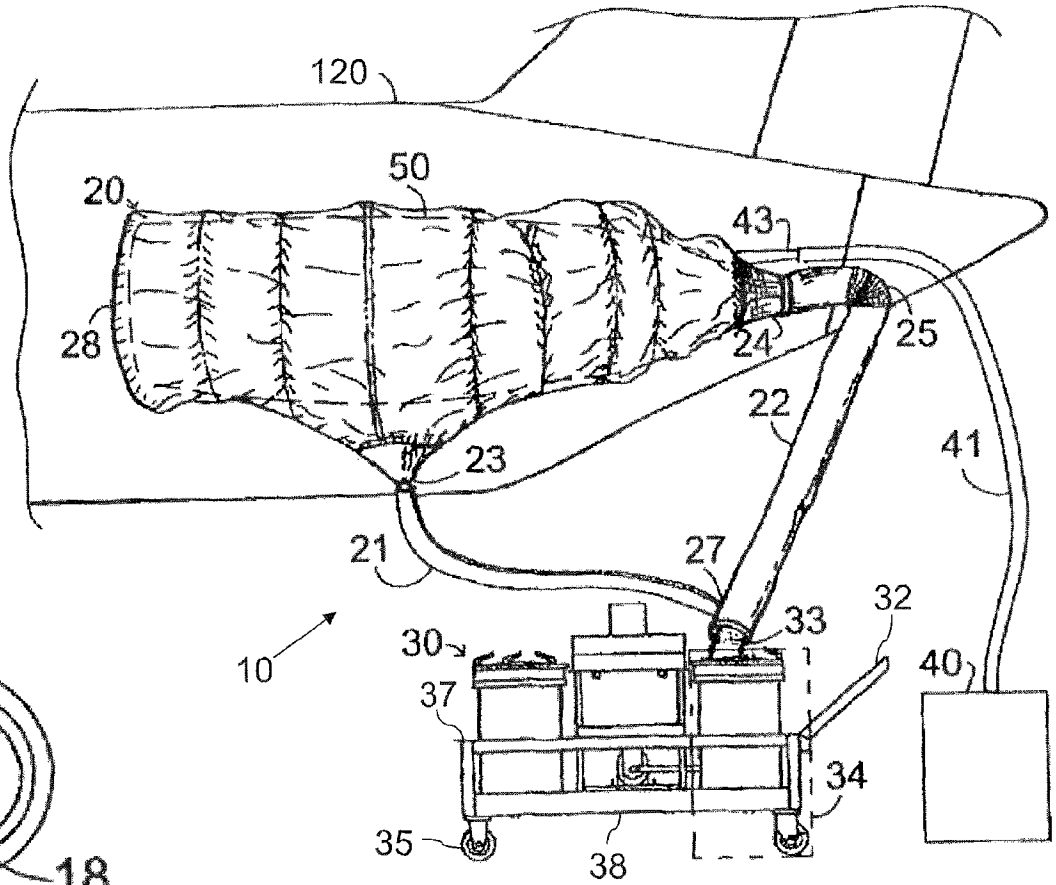
FIG. 1 is a side view of a collection system in accordance with one embodiment of the present disclosure in which a suit entirely encloses a jet engine with hoses connecting the suit to a pump, a filtering system, and a spray pump for spraying fluids into the engine.

The embodiments set forth in the drawings are illustrative in nature and are not intended to be limiting of the embodiments defined by the claims. Moreover, individual aspects of the drawings and the embodiments will be more fully apparent and understood in view of the detailed description that follows.

DETAILED DESCRIPTION

Embodiments of engine cleaning systems, which are described more fully herein, generally include a suit that may partially enclose or entirely enclose an engine, such as a turbojet and/or turbofan engine, as shown in FIGS. 1-4. The suit facilitates cleaning operations of turbojet and turbofan engines so as to allow such cleaning operations to be performed on a frequent and/or regular basis and/or at any desired time. In this manner, cleaning operations performed on regular intervals promotes engine fuel efficiency, reduces engine maintenance, and prolongs engine life, thereby reducing engine fuel, engine repair, and engine replacement costs. In addition, it is contemplated that the cleaning operations described more fully herein may be compatible with numerous different turbojet and/or turbofan engines manufactured and used worldwide, thereby providing a global solution with an environmentally safe system for gas turbine engine maintenance.

Some embodiments of the present invention further comprise a collection system. For example, in illustrative implementations, the suit is coupled to a collection system comprising hoses or other fluid conveying devices to drain the fluid used for cleaning the engine to a collection tank and/or to an effluent treatment system. The collection of effluent from cleaning operations for storage and optionally, filtration, allows the suit to be used with a system that eliminates spillage and the dumping of toxic effluent. Such systems further provide an economical and ecological solution for collection and eventual recycling or disposal of the effluent.

In certain illustrative implementations described more fully herein, a system for cleaning a jet engine comprises a waterproof suit that is capable of at least partially enclosing a body of a jet engine. The suit is used to seal off drainage from the jet engine that results from a cleaning operation. The system also comprises a collection system that includes at least one of a collecting tank or a filtering system. The collecting barrel stores the effluent collected into the suit during cleaning operations. The filtering system comprises a pumping means and a filtering means. The filtering means is capable of receiving effluent fluids used in cleaning a jet engine from, for example, two drainage hoses that are coupled to the suit. The filtering means is also capable of removing toxic elements from the received effluent fluids to make the fluid environmentally safe for disposal. The pumping means may be used, for example, to pump the filtered effluent to a water holding tank. The system still further comprises a cleaning fluid injection system having a water and cleaning material pump that is capable of pumping water or alternatively, water and cleaning materials, into at least one water and cleaner input hose and into a jet engine for the purpose of cleaning the jet engine.

Referring initially to FIG. 1, an embodiment of a system 10 for collecting effluent from a jet engine wash is illustrated according to aspects of the present invention. The system 10 includes in general, a substantially waterproof jet engine suit 20 for use in cleaning engines of an aircraft 120. The suit 20 comprises a substantially waterproof cover capable of at least partially enclosing a body of a jet engine 50 of the aircraft 120 to seal off effluent drainage from a cleaning operation implemented to clean the jet engine 50, as will be described in greater detail herein.

The cover has a form, structure and material strength capable of retaining its integrity as a seal around the body of the jet engine 50 while the jet engine 50 is turned over. In some embodiments, the cover wraps around the jet engine 50 and attaches to the jet engine pylon. Similarly, the cover has a form, structure and material strength capable of retaining its integrity as a seal around the body of the jet engine 50 while cleaning materials and water are sprayed into the jet engine 50. Moreover, the cover is capable of resisting damage from the water, the cleaning materials, and the matter removed from the jet engine 50 so that the cover can be reused in jet engine cleaning operations. The cover has a form and structure capable of fitting over a wide range of types of jet engines. The cover is fabricated, for example, of a rubberized fabric capable of resisting chemicals and impermeable to fluids. As shown in FIG. 1, the suit 20 entirely covers the jet engine 50.

Figure 2:
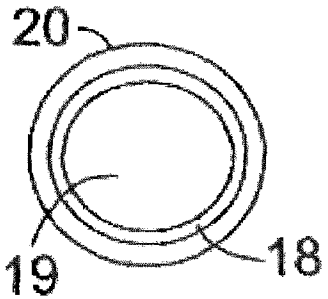
FIG. 2 is a front view of a collection system in accordance with another embodiment of the present disclosure in which a suit entirely encloses a jet engine.

Referring to FIG. 2, a front portion of the suit 20 may further comprise an elasticized rim 18 and a front opening 19. The front opening 19 is provided to admit air into the jet engine 50 for turning over the engine 50 during the engine cleaning process. The elasticized rim 18 around the front opening 19 is provided to seal the remainder of the cover tightly around the body of the jet engine 50. The elasticized rim 18 may comprise, for instance, a bungee cord loop sewn into the cover material around the perimeter of the rim.

Referring back to FIG. 1, the system 10 may also comprise a drainage system to collect and drain the effluent from the suit 20 as a result of cleaning the jet engine 50. In one exemplary embodiment, the cover has a sealed substantially waterproof connection to at least one drainage hose. For instance, in the implementation illustrated, the suit 20 is coupled to a pair of drainage hoses 21, 22 through corresponding waterproof connections 23, 24, respectively. The sealed waterproof connections 23, 24 may comprise, for example, funnel-shaped rubber boots adapted for connection to the drainage hoses 21 and 22, respectively to allow for collected effluent to drain from the suit. Moreover, in the illustrative example, the drainage hose 21 defines a bottom drainage hose 21 and the corresponding connection 23 defines a bottom sealed connection 23 to catch bottom effluent fluids in the suit 20. The drainage hose 22 defines an exhaust drainage hose 22 and the corresponding connection 24 defines an exhaust sealed connection 24 to a sealed elbow bend 25 to catch and drain away remaining effluent fluids in the suit 20.

The effluent collected by the drainage hoses 21, 22 drains via connection 27 to a storage device, such as a drum, and/or to a filtering system 30. A second connection 33 may also be utilized to couple the collected effluent to the filtering system 30. One example of a suitable filtering system 30 includes a portable filtering and processing system such as an FS-55 manufactured by Fabco Industries. The filtering system 30 may be used in cleaning the jet engine 50 to filter the matter removed from the jet engine 50 during cleaning that is collected into the suit 20, including toxic chemicals, particulates and deposits, which may contain cyanide, lead, and copper, as well as other chemicals. This portable filtering system 30 may comprise a pump and filters on a cart with a handle 32, wheels 35, side rails 37 and a base 38, which cooperate to facilitate a portable collection system.

According to still further aspects of the present invention, the system 10 may comprise a cleaning fluid injection system for inputting water and cleaners used in cleaning jet engines. In this regard, the cleaning fluid injection system may comprise a water holding tank, an injection water hose, and a water hose port. For instance, as illustrated, a water and cleaning agent injection system 40 supplies water and optionally, water and a cleaning agent, through a water and cleaner input hose 41 and through a sealed waterproof connection 43 to the suit 20. The water and cleaning agent injection system 40 is also portable and easily transported between engines and between planes. Water and, if desired, cleaning fluids in the water holding tank are injected, generally by a pump that may be incorporated into the injection system.

Figure 3:
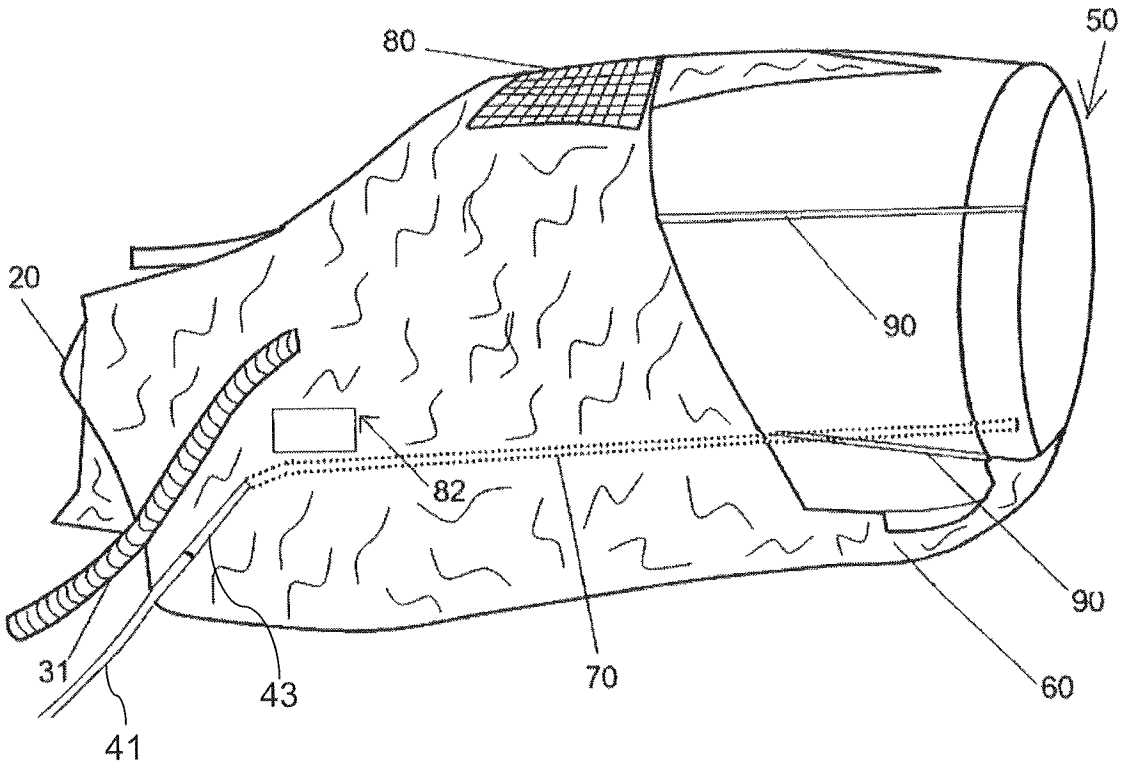
FIG. 3 is a side view of a collection system in accordance with another embodiment of the present disclosure in which a suit partially encloses a jet engine.
Figure 4:
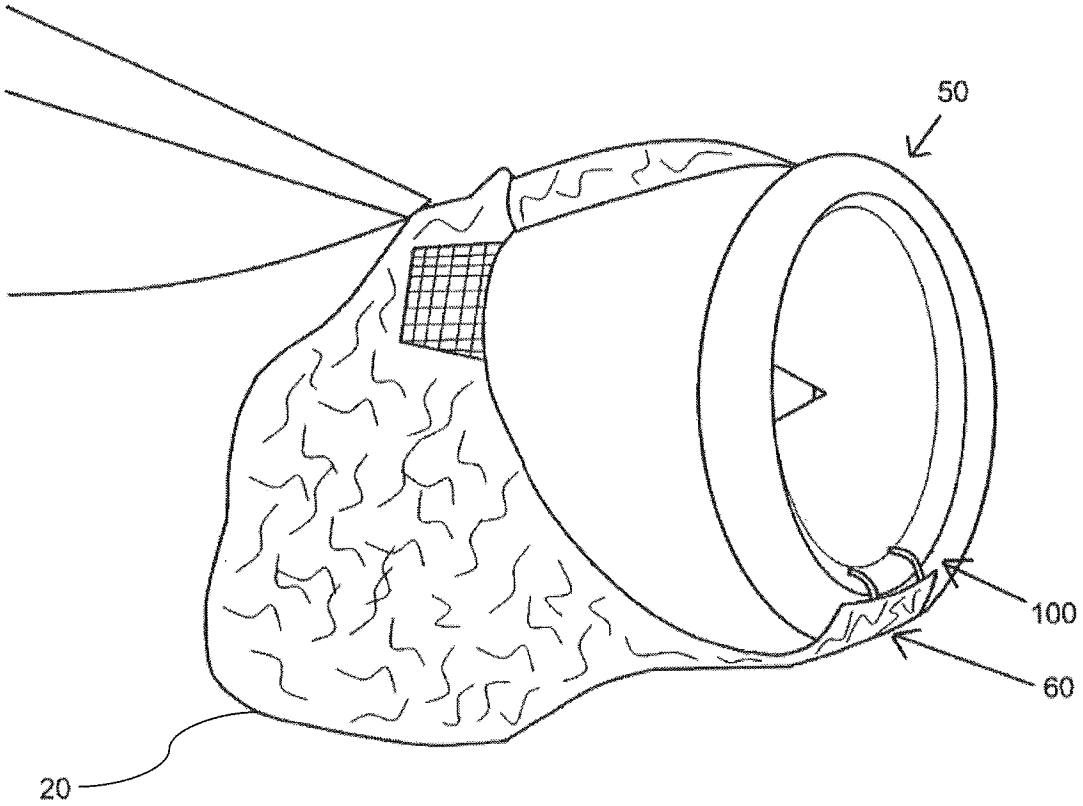
FIG. 4 is a side view of a collection system in accordance with another embodiment of the present disclosure in which a suit partially encloses a jet engine.

According to another embodiment, shown in FIGS. 3 and 4, the suit 20 is configured to partially cover a jet engine 50 and is shortened in length, thereby reducing the weight and the amount of material of the suit 20. Referring specifically to FIG. 3, the suit 20 includes an apron 60. The apron 60 of the suit 20 may help collect the effluent coming out of the drain mast under the jet engine 50 in the front section of the suit 20. The suit 20 also includes one or more meshed screens 80 that are installed in the back and/or on top of the suit 20. The meshed screen(s) 80 trap the effluent in the suit 20, while simultaneously permitting air to pass therethrough and exit the suit 20. More particularly, the meshed screen(s) prevent pressure build up in the collection system and/or the suit 20 and at the same time, prevent effluent (wastewater) from escaping the collection system and/or the suit 20 and releasing into the surrounding environment.

The suit 20 also may comprise a window 82. The window 82 may be a see-through plastic window 82 installed on one or more sides of the suit 20. The window 82 allows an operator of the collection system to monitor the amount of effluent discharged from the tail pipe and the drain ports of the jet engine 50. Still further, the suit 20 may be secured around the jet engine 50 by one or more straps 90.

According to still further aspects of the present invention, the drainage system may be vacuum-driven. For example, in the embodiment shown in FIG. 3, the drainage system comprises a vacuum hose 31 that couples for instance, to a vacuum device and a container 34 (FIG. 1). More particularly, the drainage system allows the effluent to be collected by the flexible vacuum hose 31 as the effluent exits the suit 20. The vacuum hose 31 may be connected to a vacuum that draws the effluent from the vacuum hose 31 into the container 34, such as a 55-gallon drum, or other container. A filter system, as described in greater detail above, may be inside of the container such that as the effluent is drawn into the container, the effluent passes through a series of filters for filtration treatment to at least partially cleanse the water of chemicals. The filtered water is then directed, generally by a pump, which may be incorporated into the vacuum system, back into a water holding tank of a cleaning fluid injection system. Among other components of the collection system, the water holding tank is located inside of a mobile unit such as the cart illustrated in FIG. 1, for repeat delivery and reuse. The ability to reuse the water may eliminate the need to collect and dispose of the effluent.

In the illustrative implementation of FIG. 3, generally, two water waterproof connections 43 are provided, one on each side of the suit 20 to allow the input hose 41 to get to the inside of the suit 20 so that the input hose 41 may be connected to a J hook 70, which goes through an engine bypass from the back of the jet engine 50 by an engine duct fairing. The J hooks 70 are hooked up to the front of the compressor stators of the second compressor stage. Notably, these compressor stators are stationary. The curved section of the J hook 70 hangs against an engine barrel (core) for efficient delivery of cold water, hot water, cleaning fluids, or a combination thereof into the jet engine 50 and prevents fluids from going through the engine bypass.

According to the embodiment shown in FIG. 4, one or more hooks 100 under the jet engine 50 may be attached to the apron 60 by a metal bar (not shown) going across the width of the apron 60. The hooks 100 hold the suit 20 while they attach to the lip of the inlet cowling of the jet engine 50. The hooks 100 may be used in addition to or in the alternative of the straps 90 (shown in FIG. 3) going from one side of the suit 20 to the other side of the suit 20 by going over the top of the jet engine 50.

Referring to FIGS. 1-4, additional aspects of the present disclosure relate generally to methods for cleaning jet engines using an embodiment of a collection system described herein, or inferable therefrom. One such aspect relates to a method comprising covering a jet engine 50 with a waterproof suit 20 comprising a cover capable of at least partially enclosing a body of a jet engine 50 to seal off all drainage from the jet engine 50. As mentioned above, the cover includes sealed waterproof connections 23 and 24 and correspondingly, two drainage hoses 21 and 22, for draining fluids used in cleaning the jet engine 50 and for draining the matter removed from the jet engine 50 into a filtering system. The cover further includes a sealed waterproof connection 43 to at least one water and cleaner input hose 41 for inputting water and cleaner into the jet engine 50.

Moreover, the cover has a form, structure, and material strength capable of retaining its integrity as a seal around the body of the jet engine 50 while the jet engine 50 is turned over and cleaning materials and water are sprayed into the engine. Still further, the cover is capable of resisting damage from the water, the cleaning materials, and the matter removed from the jet engine so that the cover can be reused in jet engine cleaning operations. Also, the cover has a form and structure capable of fitting over a wide range of types of jet engines.

The method further includes using a cleaning fluid pumping system 40 comprising a water and cleaning material pump to pump water and cleaning materials into at least one water and cleaner input hose 41 and into a jet engine for the purpose of cleaning the jet engine. Further, the method includes collecting and filtering effluent fluids used in cleaning a jet engine by using a filtering system 30 comprising a pump system and a filtering system capable of receiving effluent fluids used in cleaning a jet engine from the drainage hoses 21 and 22, and which is capable of filtering the effluent fluids to remove toxic elements and make the fluid environmentally safe for disposal. Moreover, the method includes pumping the effluent fluids into at least one container for disposal using a means for pumping filtered effluent fluids 30.

Some embodiments of the method further include turning over the jet engine 50 during the cleaning operation and admitting air into the jet engine 50 by means of a front portion of the cover, which includes an opening 19 to admit air into the jet engine 50 for turning over the engine in the cleaning process. The front opening can include an elasticized rim 18 around the opening to tightly seal the remainder of the cover around the body of the jet engine 50, as described more fully herein.

Figure 5:
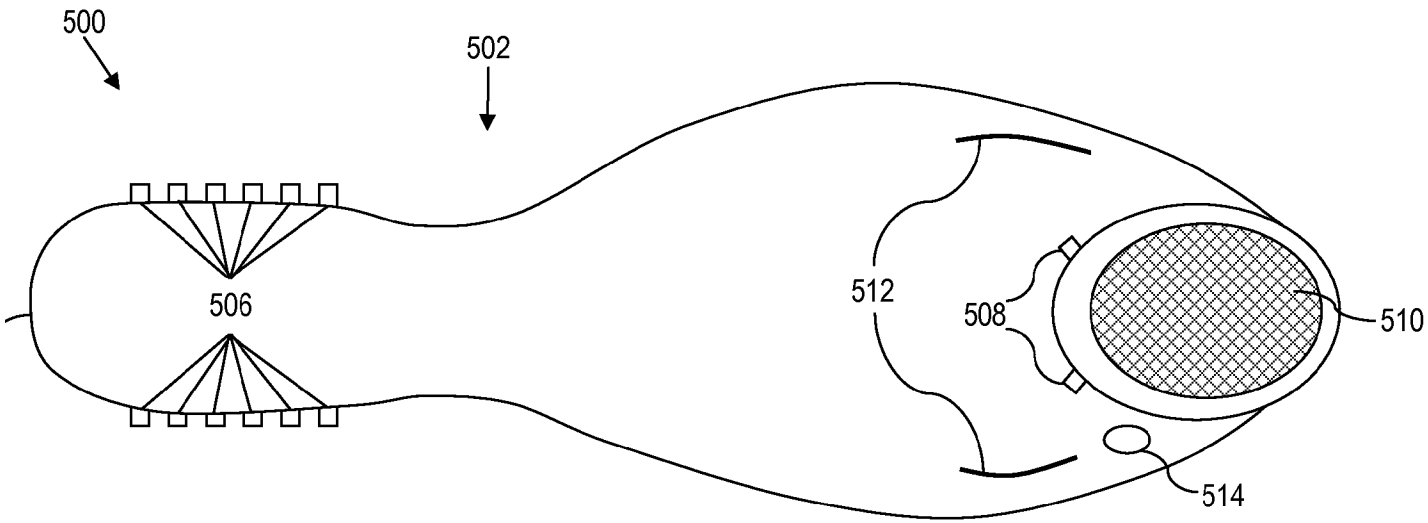
FIG. 5 is a top view of a collection system without a gravity-fed drain, according to various aspects of the present invention.
Figure 6:
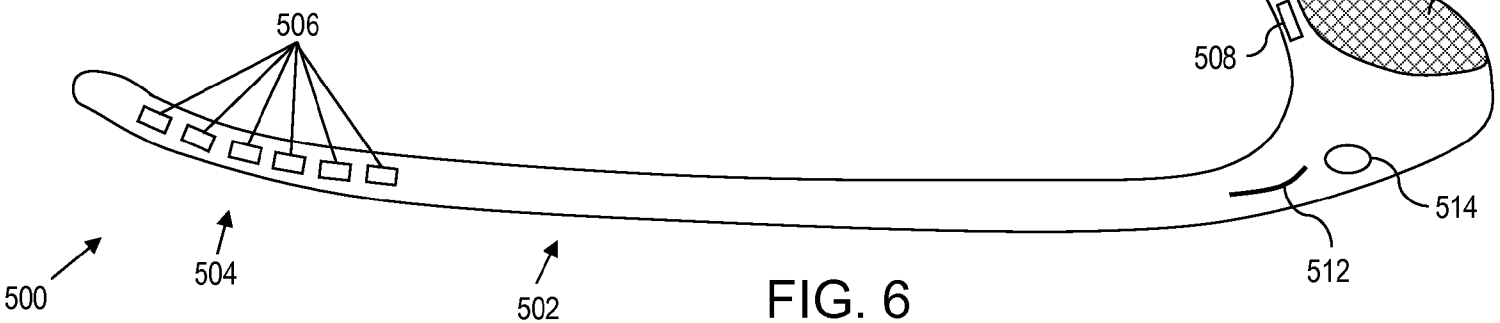
FIG. 6 is a side view of the collection system of FIG. 5, according to various aspects of the present invention.

FIGS. 5-6 illustrate embodiments of a system 500 for collecting effluent from a jet engine according to further aspects of the present invention. Notably, the system 500 includes an exemplary suit 502 similar to the suits of FIGS. 1-4; however, the suit 502 of FIGS. 5-6 does not include a drainage hose (21, 22, FIG. 1) or sealed water proof connections (23, 43, FIG. 1). Thus, the effluent remains in the suit 502 until actively removed by a user as will be described in greater detail herein. Similar to the suit of FIG. 1, the suit 502 of FIGS. 5-6 is made of a waterproof material.

Further, the suit 502 includes an apron 504 with several features to attach the suit to an engine, to adjust the overall length of the suit, or combinations thereof. For instance, as illustrated, the apron 504 includes buckles 506 on both sides of the apron 504. When attaching the suit 502 to a jet engine to be washed, a user can use the buckles 506 to adjust the overall length of the suit 502 by folding the apron 504 back on itself to a desired length and directly or indirectly buckling at least two of the apron buckles 506 together to secure the suit 502 to the desired length. While the exemplary suit 502 illustrates six pairs of apron buckles 506, any number of apron buckles 506 may be included on the suit 502. Further, other fastening methods instead of buckles may be used such as, but not limited to: hook and loop fasteners, snaps, buttons, zippers, etc., and the fasteners do not necessarily need to be in pairs. Moreover, a user can attach apron straps to the apron buckles 506 to allow for easier attachment to the jet engine, which is discussed in greater detail below in reference to FIG. 7.

The suit 502 also includes temporary securements that are utilized such that when the suit 502 is attached to the jet engine, the suit hangs, e.g., in the shape of a bowl. For instance, as illustrated, at an end opposite of the apron 504 on the exemplary suit 502 is another set of buckles (i.e. suit buckles) 508 that allow a user to attach a strap for use in attaching the suit 502 to the jet engine, which is discussed in greater detail below in reference to FIG. 7. The suit buckles 508 are not necessarily required to be at the opposite end of the suit 502. To the contrary, the suit buckles 508 just need to be positioned such that when the suit 502 is attached to the jet engine, the suit hangs, e.g., in the shape of a bowl, to collect the effluent. Further, even though two suit buckles 508 are pictured in the exemplary embodiment, the suit 502 may include more or less (including zero) buckles 508.

The exemplary suit 502 further includes mechanisms 510, 512 to prevent or relieve pressure buildup during a cleaning cycle. One of the mechanisms illustrated is a screen 510 similar to the screen 80 in FIG. 3, and another mechanism is a pressure release point 512. The pressure release points 512 are portions of the suit 502 that are normally closed, but may be opened to release pressure buildup during a cleaning cycle.

For example, as pictured, the pressure release points 512 are zippers that are shut during a normal cleaning cycle. However, if pressure builds up during the cleaning cycle, a user can unzip the zippers 512 to release the pressure. In other embodiments, the pressure release points can be other mechanisms such as snaps, hook and loop fasteners, etc. While two pressure release points 512 are shown in the exemplary suit 502, various embodiments include more or less (including zero) pressure release points 512 and may or may not include the screen 510.

As explained above, the system 500 may include an effluent removal system including a vacuum 514 and hose 515. As such, the exemplary suit 502 includes a port 516. For example, the port 516 is located generally on the bowl of the suit such that when the suit 502 is installed on an engine, the port 516 is above a highest point on the bowl that can collect effluent. The port 516 provides an opening into which a user can insert a nozzle of the vacuum hose 515 to empty the effluent collected during a cleaning cycle. Because the suit 502 does not include a drainage connection (23, FIG. 1) to connect a gravity-fed hose (21, FIG. 1) for passively emptying out the effluent, the effluent collected in the bowl should be actively removed by a user by inserting the vacuum hose 515 through the port 516 into the effluent and vacuuming the effluent out. The port 516 allows for easy access of the nozzle of the vacuum.

Figure 7:
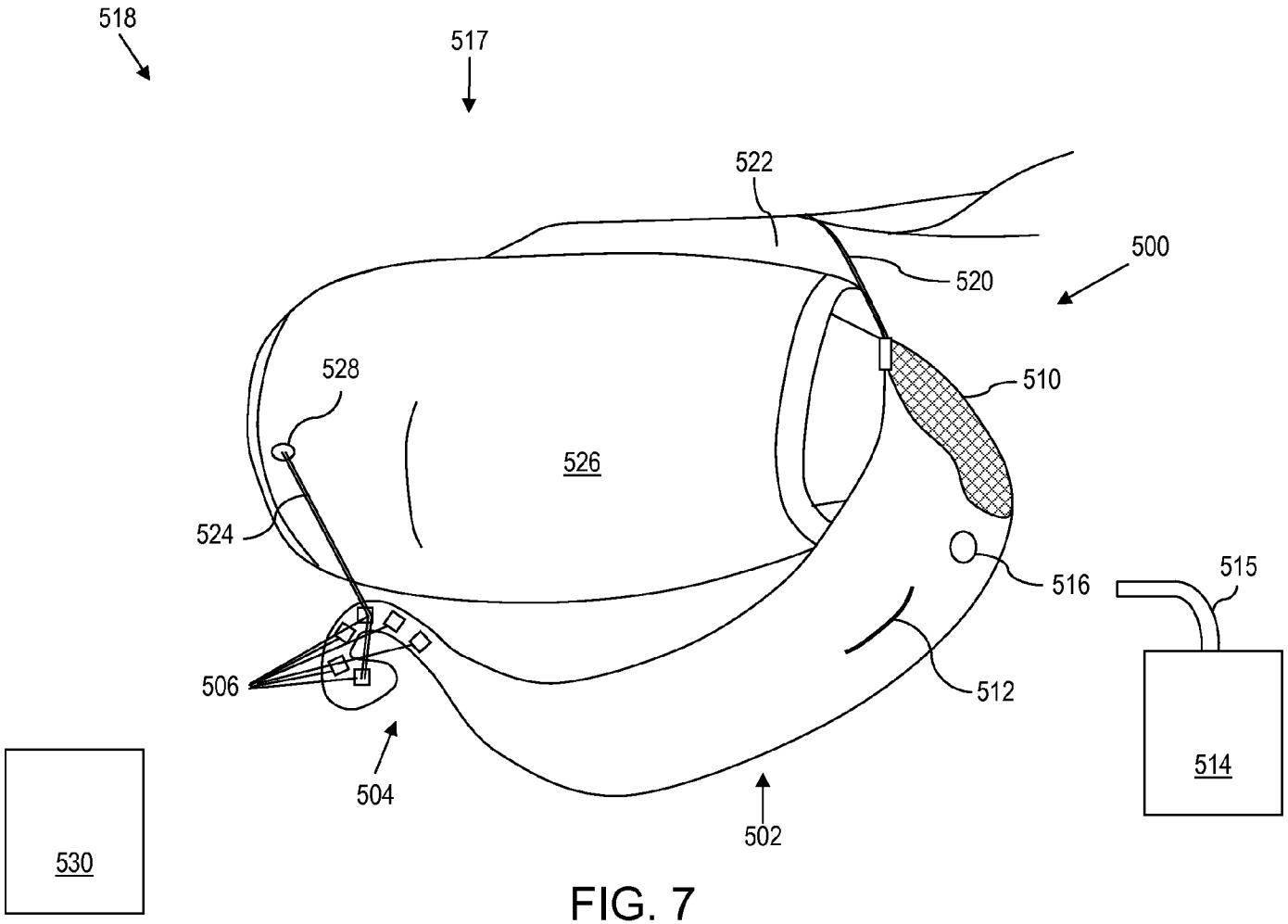
FIG. 7 is a side view of the collection system of FIGS. 5-6 attached to a jet engine pylon, according to various aspects of the present invention.

FIG. 7 illustrates the exemplary suit 502 attached to a jet engine 517 of an aircraft 518. A strap 520 coupled to the suit 502 wraps around a pylon 522 that couples the jet engine 517 to the aircraft 518, and the suit 502 hangs from the strap 520. As pictured, the strap 520 couples to the suit 502 via the suit buckles 508. However, the strap 520 may attached with other means such as, but not limited to: hook and loop fasteners, snaps, buttons, zippers, sewn or otherwise permanently attached, etc.

An apron strap 524 coupled to the apron 504 attaches to a cowling 526 of the jet engine 517, and the suit 502 hangs from the apron strap 524. As pictured, the apron strap 524 couples to the suit 502 via the apron buckles 506. However, the apron strap 524 may attach to the suit 502 with other means such as, but not limited to: hook and loop fasteners, snaps, buttons, zippers, sewn or otherwise permanently attached, etc. Further, one end of the apron strap 524 includes a suction cup 528 to attach the apron 504 to the cowling 526.

Thus, when the strap 520 is attached to the pylon 522 and the apron strap 524 is attached to the cowling 526, the suit 502 creates a bowl to collect effluent resulting from a cleaning cycle. Because the exemplary suit 502 does not require gravity to empty the bowl, the bowl may drape lower to the ground than suits that require gravity to drain and still function as a collector. Thus, the exemplary suit 502 may be used with jet engines 517 that offer little clearance between themselves and the ground. Moreover, the use of active removal of the effluent collected into the bowl allows for greater flexibility in positioning the collection system The system 500 may also include a contamination testing system 530 that tests the amount of contaminant particles in the effluent. After a cleaning cycle, the user takes a sample of the effluent and runs the sample through the contamination testing system 530 to determine the contaminant particle concentration. If the contamination concentration is greater than a predefined acceptable amount, then the user can run another cleaning cycle to reduce the contamination concentration. In some instances, the predefined acceptable amount is two-hundred-and-twenty-five (225) parts of contamination per million parts of effluent.

To use the exemplary system 500 of FIGS. 5-7, a user attaches the suit 502 to the jet engine 517 of the aircraft 518 to create a bowl under the jet engine 517 by looping the strap 520 around the pylon 522 of the aircraft 518. The user estimates a proper length for the suit 502, folds the apron 504 back to get the desired estimated length, and secures the folded portion of the apron 504 by buckling a first set of apron buckles 506 to a second set of apron buckles 506. The user washes off at least a portion of the cowling 526 and uses the suction cup 528 connected to the apron strap 524 to attach the apron 504 of the suit 502 to the cowling 526. In some instances, the user attaches a second suction cup to a generally opposite side of the cowling 526 so the suit 502 can hang more stably.

At any time, the user inserts J-hooks (70, FIG. 3) into the jet engine 518 and mechanically couples the J-hooks to the jet engine 517. The user then hooks up the J-hooks to the fluid injection system (40, FIG. 1) so the fluid injection system can inject hot fluid into the jet engine 517 during a cleaning cycle. By injecting the hot fluid by the back of the engine through the J-hook, the hot fluid is not cooled by a first compression stage in the jet engine. In some instances, a cleaning cycle includes ninety seconds of injecting fluid while turning over the jet engine 517 (without firing up the engine in most instances) and collecting effluent followed by five to ten more minutes of just collecting effluent.

During a cleaning cycle, the bowl created by the suit 502 collects effluent, which remains in the suit 502 until actively removed by the user, and the user can take a sample of the effluent to analyze in the contamination testing system 530. If the concentration of contaminants is greater than a predetermined amount (e.g., 225 parts per million) then the user can run another cleaning cycle. If not, then the user finishes up cleaning the jet engine.

At any time during the process, the user may actively remove any effluent collected by the suit 502 by using the vacuum hose 515 of the vacuum system 514. The user can either insert the nozzle of the vacuum hose 515 through the port 516 or insert the nozzle into the bowl directly (i.e., not through a portion of the suit 502). If at any time the pressure within the suit 502 builds up, the user may relieve the pressure buildup by opening a pressure release point 512 (e.g., the zipper 512).

Figure 8:
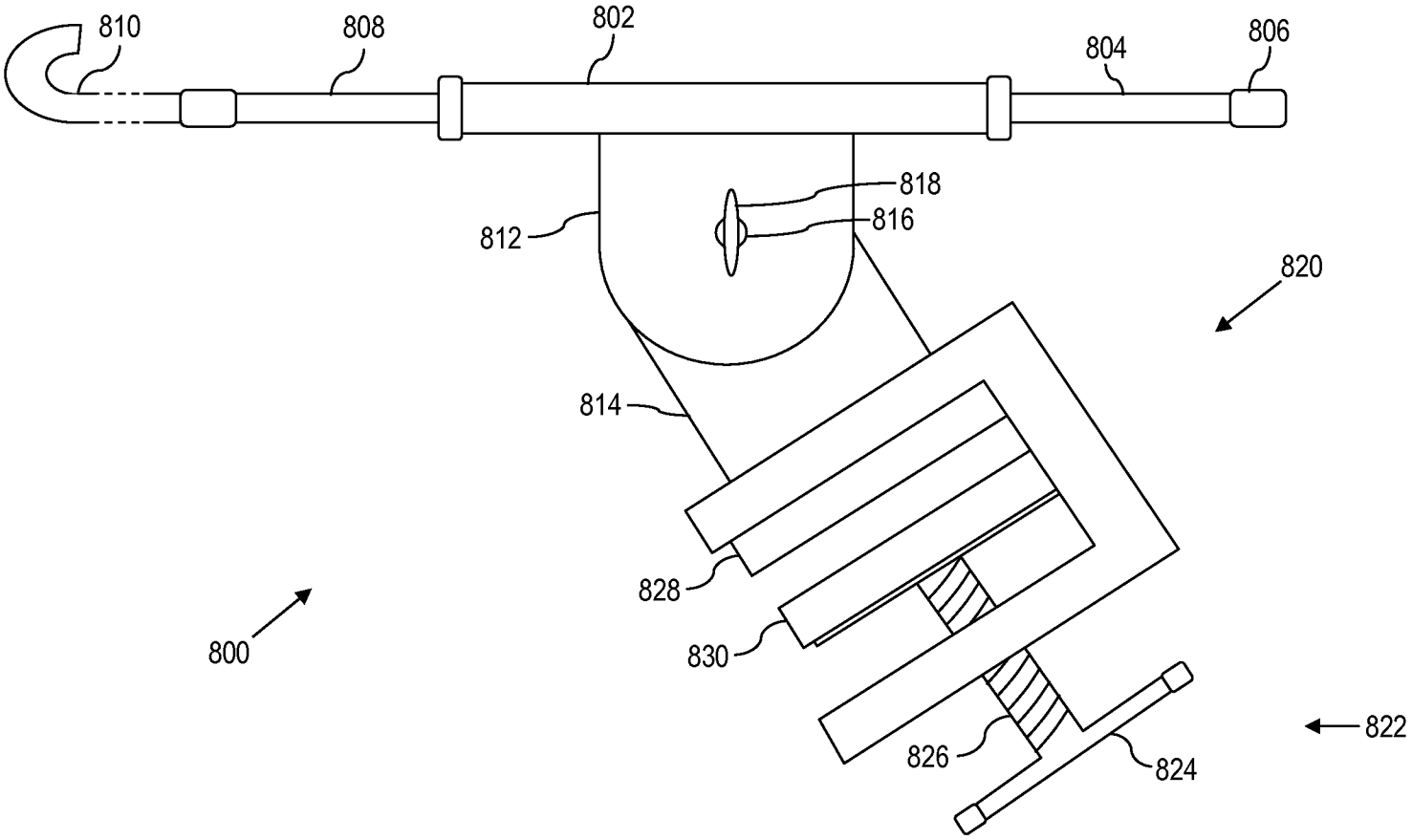
FIG. 8 is a side view of a modified J-hook, according to various aspects of the present invention.

FIG. 8 illustrates an exemplary modified J-hook 800 for use in cleaning a jet engine of an aircraft. The J-hook 800 includes a hollow tube 802 with an input end 804 that includes a male portion of a quick-connect coupler 806 and an output end 808 with a coupler. The male quick-connect coupler 806 couples to the hose of the fluid injection system described above. The coupler on the output end 808 couples to a hollow tube 810 that curls back to create the "J" portion of the J-hook 800.

The tube 802 is coupled to a first plate 812, which couples to a second plate 814 via pivot point 816. In some embodiments, the pivot point 816 includes a tightening mechanism 818 such as a screw or a thumb screw that locks the two plates 812, 814 at a desired angle. In various embodiments, the coupled surfaces of the plates 812, 814 are machined with teeth and grooves to aid in locking the plates 812, 814 at the desired angle.

The second plate 814 is coupled to a C-clamp 820 which includes a tightening portion 822. In the exemplary J-hook 800, the tightening portion 822 is a T-handle coupled to a threaded shaft 826, which threads into the C-clamp 820. When a user rotates the T-handle 824, the shaft 826 extends further into the C-clamp 820 or retracts out of the C-clamp 820. The bottom of the C-clamp includes a first pressure plate 828, and the shaft 826 couples to a second pressure plate 830.

When a user wants to attach the J-hook 800 to a jet engine, the user adjusts the angle of the plates 812, 814 such that the tube is generally parallel with an axis of the jet engine. Then, the user can tighten the thumb screw 818 on the pivot point 816 to lock the angle. The user can then tighten the C-clamp 820 such that the two pressure plates 828, 830 mechanically couple the J-hook to the jet engine.

While certain representative details have been shown for purposes of illustrating an embodiment of the invention, it will be apparent to those persons skilled in the art that various changes in the methods and apparatus disclosed herein may be made without departing from the scope of the invention. Further, the embodiments described and illustrated herein are provided for exemplary purposes only and various other embodiments may be derived or inferred therefrom.

Further, it is noted that recitations herein of a component of an embodiment being "configured" in a particular way or to embody a particular property, or function in a particular manner, are structural recitations as opposed to recitations of intended use. More specifically, the references herein to the manner in which a component is "configured" denotes an existing physical condition of the component and, as such, is to be taken as a definite recitation of the structural factors of the component.

It is noted that terms like "generally," "commonly," and "typically," when utilized herein, are not utilized to limit the scope of the claimed embodiments or to imply that certain features are critical, essential, or even important to the structure or function of the claimed embodiments. Rather, these terms are merely intended to identify particular aspects of an embodiment or to emphasize alternative or additional features that may or may not be utilized in a particular embodiment.

For the purposes of describing and defining embodiments herein it is noted that the terms substantially," "significantly," and "approximately" are utilized herein to represent the inherent degree of uncertainty that may be attributed to any quantitative comparison, value, measurement, or other representation. The terms "substantially," "significantly," and "approximately" are also utilized herein to represent the degree by which a quantitative representation may vary from a stated reference without resulting in a change in the basic function of the subject matter at issue.

Having described embodiments of the present disclosure in detail, and by reference to specific embodiments thereof, it will be apparent that modifications and variations are possible without departing from the scope of the embodiments defined in the appended claims. More specifically, although some aspects of embodiments of the present disclosure are identified herein as preferred or particularly advantageous, it is contemplated that the embodiments of the present disclosure are not necessarily limited to these preferred aspects.

What is claimed is:

1. A method for washing a jet engine of an aircraft, the method comprising:

coupling a suit to a jet engine to create a collecting bowl by:

using a suction cup to couple an apron of the suit to a cowling of the jet engine; and sizing the suit to the jet engine by:

folding a portion of the apron back; and buckling a first set of apron buckles to a second set of apron buckles to secure the folded portion of the apron;

injecting cleaning fluid into the jet engine while the jet engine is turning over; and collecting resultant effluent in the bowl wherein the effluent remains in the bowl until actively removed by a user by an action selected from the group consisting of:

inserting a vacuum hose through a port of the bowl and vacuuming out the effluent; and inserting the vacuum hose directly into the bowl independently of a port and vacuuming out the effluent.

2. The method of claim 1, wherein injecting cleaning fluid into the jet engine comprises:

coupling a J-hook to the jet engine;

heating the cleaning fluid; and injecting the heated cleaning fluid into the jet engine through the J-hook.

3. The method of claim 1, wherein:

collecting resultant effluent in the bowl wherein the effluent remains in the bowl until actively removed by a user comprises an action selected from the group consisting of:

inserting a nozzle of a vacuum through a port in the bowl; and vacuuming the effluent from the bowl.

4. The method of claim 1 further comprising:

testing the effluent for contaminants; and injecting cleaning fluid into the jet engine and turning over the jet engine again if the concentration of contaminants in the effluent is greater than a predetermined value.

5. The method of claim 4, wherein injecting cleaning fluid into the jet engine and turning over the jet engine again if the concentration of contaminants in the effluent is greater than a predetermined value includes injecting cleaning fluid into the jet engine and turning over the jet engine again if the concentration of contaminants in the effluent is greater than 225 parts per million.

6. The method of claim 1, wherein coupling the suit to the jet engine includes coupling the suit to a pylon that attaches the jet engine to the aircraft.

7. A method for washing a jet engine of an aircraft, the method comprising:

coupling a suit to a jet engine to create a collecting bowl;

injecting cleaning fluid into the jet engine while the jet engine is turning over;

relieving pressure buildup by opening pressure release points in the suit; and collecting resultant effluent in the bowl wherein the effluent remains in the bowl until actively removed by a user by an action selected from the group consisting of:

inserting a vacuum hose through a port of the bowl and vacuuming out the effluent; and inserting the vacuum hose directly into the bowl independently of a port and vacuuming out the effluent.

8. The method of claim 7, wherein relieving pressure buildup by opening pressure release points in the suit further includes opening zippers embedded into the suit.

9. The method of claim 7, wherein injecting cleaning fluid into the jet engine comprises:

coupling a J-hook to the jet engine;

heating the cleaning fluid; and injecting the heated cleaning fluid into the jet engine through the J-hook.

10. The method of claim 7, wherein:

collecting resultant effluent in the bowl wherein the effluent remains in the bowl until actively removed by a user comprises an action selected from the group consisting of:

inserting a nozzle of a vacuum through a port in the bowl; and vacuuming the effluent from the bowl.

11. The method of claim 7 further comprising:

testing the effluent for contaminants; and injecting cleaning fluid into the jet engine and turning over the jet engine again if the concentration of contaminants in the effluent is greater than a predetermined value.

12. The method of claim 11, wherein injecting cleaning fluid into the jet engine and turning over the jet engine again if the concentration of contaminants in the effluent is greater than a predetermined value includes injecting cleaning fluid into the jet engine and turning over the jet engine again if the concentration of contaminants in the effluent is greater than 225 parts per million.

13. The method of claim 7, wherein coupling the suit to the jet engine includes coupling the suit to a pylon that attaches the jet engine to the aircraft.

* * * * *